United States Patent [19]

Pliml, Jr.

[11] 4,104,492

[45] Aug. 1, 1978

[54] GRAVITY ACTUATED LIGHT SOCKET AND SWITCH MEANS

[75] Inventor: Frank V. Pliml, Jr., Arlington Heights, Ill.

[73] Assignee: Illinois Tool Works Inc., Chicago, Ill.

[21] Appl. No.: 836,182

[22] Filed: Sep. 23, 1977

[51] Int. Cl.[2] ..... H01R 33/28

[52] U.S. Cl. ..... 200/51.14; 200/61.52; 200/153 A; 200/DIG. 29

[58] Field of Search ..... 200/51.14, 61.52, 153 A, 200/150 A, DIG. 29, 60

[56] References Cited

U.S. PATENT DOCUMENTS

| | | | |
|---|---|---|---|
| 2,487,433 | 11/1949 | Gardenhour | 200/153 A |
| 2,503,383 | 4/1950 | Gesswein | 200/153 X |

*Primary Examiner*—George T. Hall

*Attorney, Agent, or Firm*—Jack R. Halvorsen; Robert W. Beart

[57] ABSTRACT

A combined gravity operated light socket and switch including a base, fastening means extending from one side thereof and a dielectric housing extending from the other side, the housing being divided into two adjacent chambers. The first chamber is open-ended forming a light socket and the second chamber houses a switching mechanism. The switch includes a headed co-axial shaft extending between the chambers with the head acting as a contact in the base of the socket and the opposite end carrying a flat centrally flanged teeter-totter element supporting a rolling ball and arranged for predetermined angular movement upon angular shifting of the housing. The angular movement of the flat element is limited by stop means, one of which is a contact, thereby producing an on-off status depending on the angular placement of the unit.

11 Claims, 6 Drawing Figures

GRAVITY ACTUATED LIGHT SOCKET AND SWITCH MEANS

BACKGROUND OF THE INVENTION

Gravity operated switches for controlling the actuation of lamps and light sources is well known in the art. Many of such switches utilize a small quantity of mercury within a glass vial that is displaced between opposite ends of the vial by tipping the vial. Movement of the mercury will bring it into touching relationship to one or more contacts disposed within the vial for closing a circuit with a source of electrical supply. Similarly, the U.S. Patent to Gardenhour No. 2,487,433 discloses a glass vial filled with a suitable arc quenching fluid, such as oil, and utilizes a rolling ball for providing the necessary weight to engage two contacts, one of which is carried by a canti-lever spring member. Another example of a ball member for insuring contact, dependent upon an angular disposition of the article to which it is attached, is shown in the U.S. Pat. to Stephens No. 2,328,855. In most instances, in the prior art, the switch element is independent of the socket member and not only requires mounting means but also requires delicate handling due to the glass vial envelope used for the switch. Similarly, such glass envelopes are prone to become embrittled when subjected to low temperatures and hence are not ideally suited for use with refrigerators or freezers. Costs of such switches, while relatively economical, are not as inexpensive as a mechanical switch.

SUMMARY OF THE INVENTION

The present invention contemplates a rugged, dependable, gravity actuated light socket and switch combination which can be rapidly assembled with an apertured panel capable of being angularly moved about a horizontal axis. The combined unit can be snapped into an apertured panel, quickly connected to an electrical source of power and is capable of withstanding wide changes in temperature gradients.

Another object of the present invention is to provide a unitized assembly that can be economically fabricated, readily assembled and rapidly installed in final position for use.

The split half design of the present invention contemplates a "lay-in" type of assembly and with matching halves of a dielectric case provides two chambers, one of which is open at one end for acceptance of a lamp or light while the second chamber is sealed and carries the switching elements. The simplicity of design affords rapid assembly, tamper-proof construction and insures operation under widely varying gradients of temperature.

Other objects will be apparent to those skilled in the art when the detailed specification is read and study made of the accompanying drawings.

DETAILED DESCRIPTION OF THE INVENTION

Figure 1:
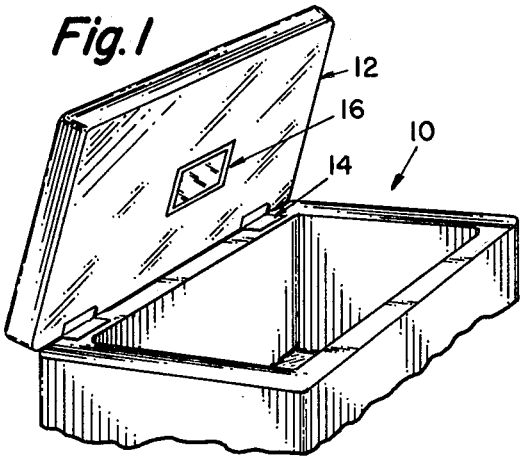
FIG. 1 is a partial perspective view of a chest-like element utilizing an embodiment of the present invention mounted in recessed relationship to its lid.

FIG. 1 discloses a chest-like member 10 having a lid 12 capable of movement about a horizontal axis or hinge means 14 and provided with a recessed lighting element 16 on the undersurface of the lid. Such lighting elements have been known in the past and frequently are mounted in the chest per se with gravity operated switching means being located in the lid 12.

Figure 2:
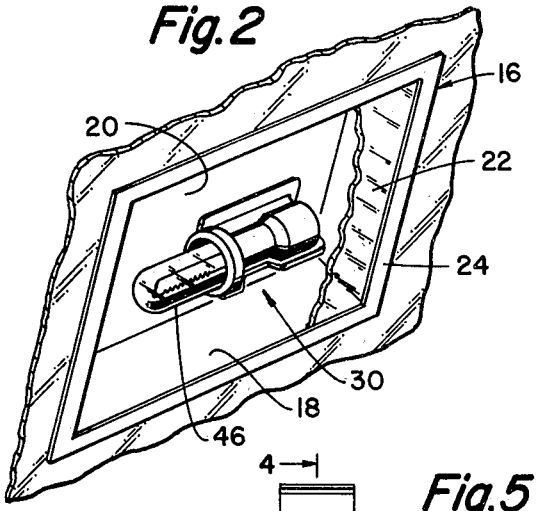
FIG. 2 is a partial perspective fragmentary view of the embodiment of the present invention as it is located in a recessed pan in the lid of the device shown in FIG. 1.

As can be best seen in FIG. 2, the lighting element 16 includes a recess pan having side walls 18 and a recessed apertured base support panel 20. A light defusing glass or plastic element 22 covers the recess and generally is supported by an encircling vecel 24 which is removeable for purposes best set forth hereinafter.

The present invention primarily relates to a combined light socket and gravity-actuated switch means 30 contained in a common dielectric housing 32. The housing 32 preferably is formed by two mating halves 34 and 36 which, when assembled, form two co-axial chambers 38 and 40 with chamber 38 having a flared mouth open end 42 and suitable means, such as screw threads 44, disposed on the inner surfaces forming the chamber, in the present instance helical threads, for the acceptance of the base of an electric light 46.

The housing further includes a base means 50 for bearing against the apertured support panel 20 and supporting the housing 32 generally parallel thereto. Extending outwardly from the opposite side of base 50 is a shroud 52 forming a chamber 54 for purposes best set forth hereinafter. A pair of resilient reversely bent arm means 54 and 56 each provided with tapered shoulder means 58 and 60, respectively, extend toward the base 50 and have at their free extremities an extension 62 and 64, respectively, on the two arms.

Figure 3:
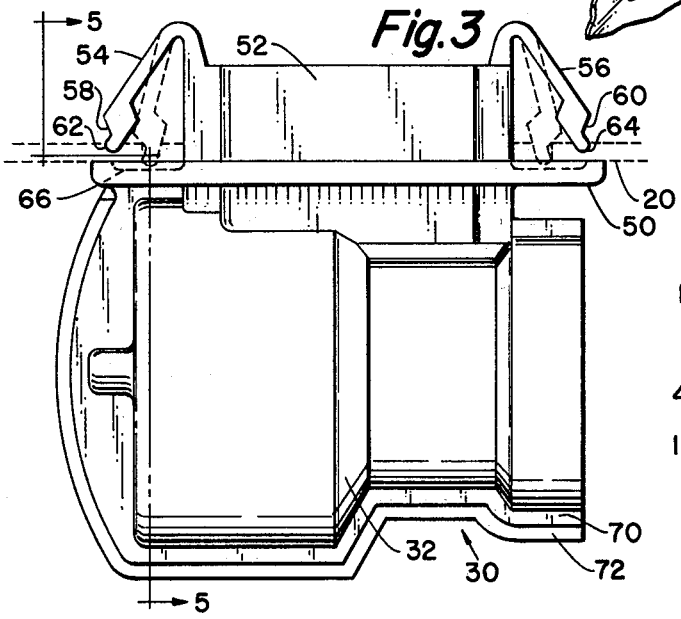
FIG. 3 is an elevational view showing the device contemplated by the present invention as formed, and in phantom as assembled to a supporting panel.

It will be noted in FIG. 3 that the base 50 is recessed as at 66 to accept the extensions 62 and 64 when the arms 54 and 56 are flexed inwardly when the device is introduced into the apertured panel 20. The extensions 62 and 64 resist the outward reverse movement of the arms should excessive forces be applied to the housing 32 in attempting to remove it from the apertured panel.

Figure 5:
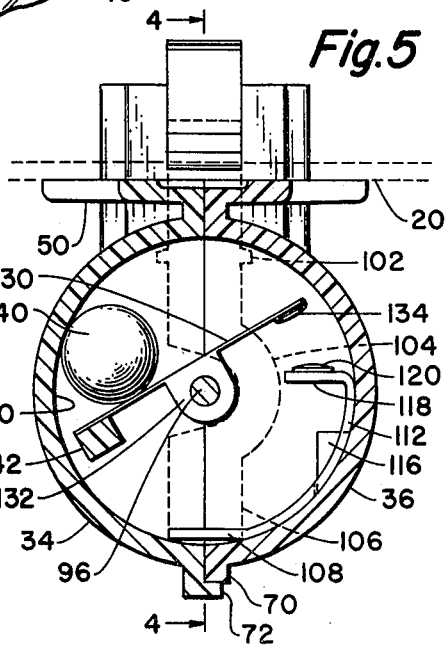
FIG. 5 is an end elevational view taken along line 5—5 of FIG. 3 showing the switching mechanism in the off position.
Figure 4:
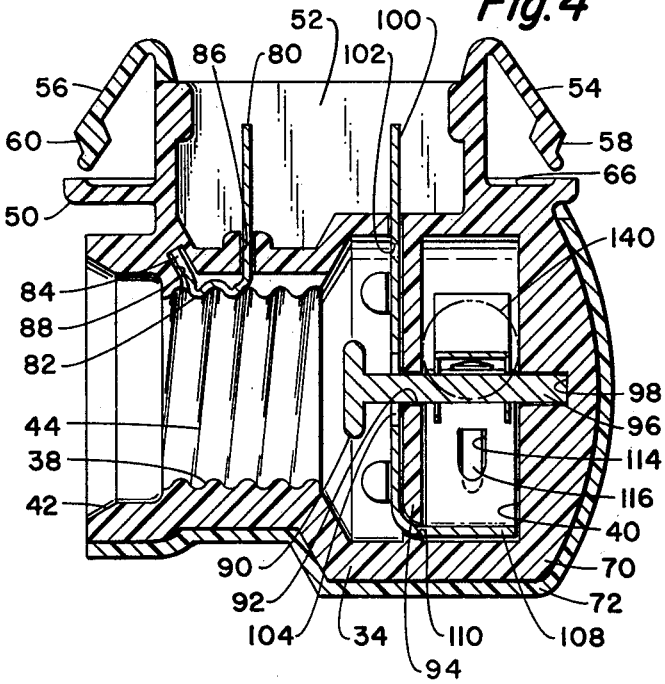
FIG. 4 is an elevational sectional view taken along line 4—4 of FIG. 5.

As can be best seen in FIGS. 4 and 5, the two halves of the housing 34 and 36 are fabricated from a dielectric plastic material that can be suitably injection molded. Some such suitable materials are polypropylene, acrylonitrile-butadiene-styrene, modified phenylene oxide, as well as other thermal plastic materials available for such useage. It will be noted that housing 36 includes a lateral flange 70 that nests within an overlying flange 72 of housing 34. This insures total sealing of the housing by suitable known means, such as sonic welding, adhesive means or heat sealing.

Referring now to FIGS. 4 and 5, the two halves of the housing 32 are provided with various slots and cavities to permit assembly of the various components, either manually or by automated fixturing. The socket contact means include a flat conductive sheet material element that is formed with a tail 80, a corrugated angularly disposed portion 82 and a locating flange 84. The flat portion 80 is inserted within a slot means 86 and with the reversely bent element 84 also being positioned within a secondary slot 88. Slots 86 and 88 are shown as oversize for clarity in illustration; however, for maintenance of tolerances, the contact 80 would be inserted by a friction fit. The corrugations 82 are complementary to the helical thread 44 and will accept the metallic threads on a electric light. The second contact means within the socket is provided by a headed pin 90 supported by a pressfit, or ultrasonically joined when anchored into the assembly, in slot 92 located in wall 94 that separates chamber 38 from chamber 40. The headed pin 90 includes an axial shaft 96 that is supported at its opposite end in a recess or blind bore 98. The pin 90 is coaxial with chamber 38 and is adapted to contact the normal isolated co-axial contact on an electric lamp. Once again, the slot 92 and the recess 98 are shown as being oversized when, in actual production, the pin 90 would be located by a friction fit in the final assembly.

A second contact 100 is located within chamber 54 of shroud 52. The contact 100 includes a straight male form of connector within chamber 54, a pair of locating ears 102 and a centrally arcuate portion 104 that is spaced from the headed pin 90. The arcuate portion 104 connects the upper, as viewed in the drawing, straight portion 100 to a second straight portion 106 and is then bent at right angles to form a third portion 108 with the connection passing through wall 94 by means of slot 110 with the straight portion 108 being disposed within the switch chamber 40. The sheet material is then bent into an arcuate form 112 and provided with a centrally disposed slot 114 adapted to accept a locating lug 116 therethrough. The upper extremity of the arcuate portion 112 is angularly disposed, approximately perpendicular to the tangent, to form a stop 118 supporting a contact 120.

The shaft 96 carries a flat conductive element 130 including a pair of medially disposed apertured flanges 132 which accept the shaft 96. The element 130 has sufficient length to carry a contact 134 that mates with fixed contact 120. Positioned atop teeter-totter element 130 is either a weighted sphere, ball or cylinder 149 having a diameter such that it will freely roll within the confines of the chamber 40. While the contact 120 limits the angular movement of element 130 in one direction, a stop 142 extends inwardly from the wall 94 of housing half 34 to limit the angular movement in the opposite direction. Stop 142 can be positioned at any point to insure operation of the switching mechanism.

The elements 80, 90 and 100, along with the ball 140, are positioned within the half 36 and thence the second half 34 is superimposed thereon to capture the elements and form the closed chamber 40 and the open-ended socket 38. As has been previously indicated, the various slots and grooves within which the elements are normally placed are a friction or pressfit to insure retention and alignment of the elements, even though the drawing shows the slots as being in excess of the desired fit, for purposes of illustration only. As was previously indicated after the two halves are assembled, they are then suitably affixed to one another by sonic welding, adhesive means or heat sealing, dependent upon the type of thermoplastic material from which the housing is formed.

The device is then connected to a power source by suitable female terminals, not shown, being affixed to the contacts 80 and 100 within the shroud chamber 54. This insures an insulative arrangement within the lid 12 and following such connections the legs 54 and 56 are depressed laterally for insertion within the apertured support panel 20. A light bulb is then screwed into the socket 38 and appropriate contact made with the corrugated portion 82 and the headed pin 90.

Figure 6:
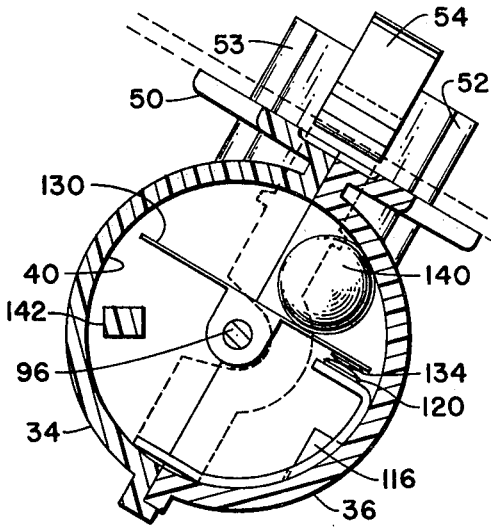
FIG. 6 is a similar end elevational view in partial section showing the device in angular position and with the switching mechanism in the on position.

As can be best seen in FIGS. 4 through 6, power to the light bulb is provided by the one contact 80 and the second contact 100 with current passing through the sheet metal element up to contact 120. As the lid 12 is angularly moved from its closed position, as shown in FIG. 5, to at least that position shown in FIG. 6, the ball 140 will roll down element 130 causing the contact 134 to be brought into intimate relation with contact 120, the weight of the ball insuring good contact. Current then flows through contact 134, element 130 and thence down shaft 96 to the headed end 90 where it completes the circuit with the light bulb. It will be appreciated that stop means 142 can be positioned at a variety of locations to control the limits of angular movement of element 130 as it rotates about shaft 96. The contacts 80, 90 and 100 are preferably fabricated from non-corrosive metallic materials, such as brass, bryllium, copper or the like. The preferred embodiment of ball 140 is carbon steel copper plated. Other variations will be apparent to those skilled in the art.

I claim:

1. A gravity actuated light socket and switch means including a dielectric light socket having a horizontal axis, means adapted for retaining said socket in mounted relation to an apertured panel fixed on a support member angularly moveable about a horizontal axis, multiple socket contact means for connection to and conveying a source of power to and from said socket, moveable switch contact means teeter-totter fashion intermediate its extremities on a horizontal shaft connected to one of said socket contact means, moveable weight means shiftable along said contact means in response to angular movement of said support member, stop means for controlling the angular shifting of said moveable switch contact means between a first angular disposition of said light socket and a second angular disposition, the second one of said stop means being a fixed contact connected to a power source and adapted to be touched by said moveable switch contact means when said light socket is placed in said second disposition by shifting of said moveable weight means, whereby power is supplied to said socket contacts.

2. A socket of the type claimed in claim 1 wherein said socket and switch are housed in a common plastic member of mating halves formed about a common axis, including an open ended socket chamber and an axially adjacent closed switch chamber, and snap engaging means for retention of said socket and switch to said panel.

3. A socket of the type claimed in claim 2 wherein one of said socket contacts is directly connected to one lead of a power source, the second socket contact being connected to said switch means, said second socket contact including a horizontally co-axially disposed shaft element passing between said two chambers and enlarged at one end within said socket to form said second socket contact and the other end portion forming said horizontal shaft.

4. A socket of the type claimed in claim 3 wherein said moveable switch contact includes a substantially flat centrally flanged metallic element mounted for rotation about said shaft between predetermined angular limits, one of said limits being defined by said fixed contact connected to a second lead to a power source.

5. A socket of the type claimed in claim 4 wherein said shiftable weight is a metallic ball rolling on said flat metallic element and adapted to act as an over-center action device as said socket is moved from one angular disposition to a second disposition to thereby insure pressure between said flat metallic element and said limits.

6. A socket of the type claimed in claim 5 wherein said switch chamber is cylindrical, said ball having a predetermined diameter and the spacing between the cylindrical wall of said switch chamber and said flat metallic element as it rotates on said shaft is sufficient to permit movement of said ball along a substantial portion of the length of said metallic element.

7. A socket of the type claimed in claim 6 wherein said socket-switch includes a base supporting said two chambers in a horizontal attitude, shroud means extending outwardly from said base from the opposite side of said chambers, lead means located within said shroud for connection to said power source.

8. A socket of the type claimed in claim 7 wherein said shroud means carries resilient and shouldered arm means extending toward said base for engagement with the rear side surface of said apertured panel engaged on the front side by said base.

9. A light socket and gravity operated switch member combination including a dielectric housing having a base, resilient snap fastening means extending outwardly from said base in one direction and a pair of adjacent horizontally disposed chambers extending outwardly in the opposite direction from said base, one of said chambers being an open ended socket and adapted to accept a light bulb base therein through said open end, fixed first and second socket contact means being disposed in the side wall and co-axially with the base of said socket chamber respectively, said second base socket contact means including a head conductive shaft extending between said first and second chambers with the head portion thereof being located in said socket chamber, a substantially flat teeter-totter type conductive member mounted on said shaft in said second chamber and carrying contact means at one end thereof, limit stops positioned within said second chamber for limiting the rotation of said flat member about said shaft, one of said limit stops being a fixed switch contact connected to one lead of a power source, a metallic ball riding on said flat member within said second switch chamber to ensure rotational movement of said member about said shaft during angular movement of said entire socket-switch combination to move the contact carried by said flat member into engagement with said fixed switch contact to supply power to said second base contact means, and a second lead of said power source connected to said first side wall socket contact means.

10. A socket-switch means of the type claimed in claim 9 wherein said housing base includes shroud means surrounding the connectors adapted to be associated with the power source leads.

11. A socket-switch member of the type claimed in claim 9 wherein the said second switch chamber is substantially cylindrical internally thereof, said ball has a predetermined diameter, the surface of said flat member at a predetermined angular relationship dependent on the relative position of the ball along the length thereof being positioned a distance from said cylindrical wall substantially identical to said predetermined diameter.

* * * * *